US009559452B1

(12) United States Patent
Mugan

(10) Patent No.: US 9,559,452 B1
(45) Date of Patent: Jan. 31, 2017

(54) HOUSING FOR ELECTRICAL CONTACT

(71) Applicant: AMPHENOL CORPORATION, Wallingford, CT (US)

(72) Inventor: Shan Mugan, Markham (CA)

(73) Assignee: AMPHENOL CORPORATION, Wallingford, CT (US)

( * ) Notice: Subject to any disclaimer, the term of this patent is extended or adjusted under 35 U.S.C. 154(b) by 0 days.

(21) Appl. No.: 14/821,063

(22) Filed: Aug. 7, 2015

(51) Int. Cl.
*H01R 13/40* (2006.01)
*H01R 13/422* (2006.01)
*H01R 43/20* (2006.01)

(52) U.S. Cl.
CPC ..... *H01R 13/422* (2013.01); *H01R 43/20* (2013.01)

(58) Field of Classification Search
CPC ..... H01R 13/426; H01R 13/434; H01R 13/20; H01R 31/02; H01R 13/111; H01R 4/34; H01R 4/64; H01R 4/4809; H01R 9/16; H01R 13/4223; H01R 13/4365; H01R 13/4364; H01R 13/4362; H01R 13/422; H01H 1/58
USPC ..... 439/744, 745, 748, 595, 625
See application file for complete search history.

(56) References Cited

U.S. PATENT DOCUMENTS 2,477,849 A * 8/1949 Adams ..... H01R 13/434 439/745
3,143,385 A * 8/1964 Zimmerman, Jr. ..... E04G 7/24 439/744
3,229,244 A * 1/1966 Bachman ..... H01R 13/426 439/744
3,475,720 A 10/1969 Culver
3,494,998 A 2/1970 Anhalt
3,571,784 A 3/1971 Naus et al.
3,648,213 A * 3/1972 Kobler ..... D06P 1/667 439/586
3,766,513 A * 10/1973 Carre ..... H01R 13/428 439/171
4,082,398 A * 4/1978 Bourdon ..... H01R 13/4226 439/595
4,128,293 A 12/1978 Paoli
4,157,806 A * 6/1979 Bourdon ..... H01R 13/4226 249/145
4,272,149 A * 6/1981 Gallusser ..... H01R 13/428 439/426
4,278,317 A * 7/1981 Gallusser ..... H01R 13/111 439/744
4,374,604 A * 2/1983 Hemmer ..... H01R 9/15 439/587
4,386,816 A * 6/1983 Frear ..... H01R 13/424 439/595

(Continued)

*Primary Examiner* — Abdullah Riyami
*Assistant Examiner* — Vladimir Imas
(74) *Attorney, Agent, or Firm* — Blank Rome LLP

(57) ABSTRACT

A housing for an electrical contact that includes a unitary one-piece body that has an internal bore that extends between a front end and an opposite rear end of the unitary one-piece body and is adapted to receive the electrical contact. A front holding member extends into the internal bore from an inner surface of the internal bore, and the front holding member is located at the front end of the one-piece body. A rear holding member extends into the internal bore, and is disposed on the inner surface of the internal bore at the rear end of the one-piece body. A contact retaining member receiving area is defined in the internal bore between the front holding member and the rear holding member for capturing a contact retaining member therebetween.

20 Claims, 3 Drawing Sheets

(56) References Cited

U.S. PATENT DOCUMENTS 4,387,945 A 6/1983 MacAvoy
4,395,083 A * 7/1983 Frear ..... H01R 13/424 439/595
4,418,946 A * 12/1983 Gambon ..... F16B 7/20 285/148.2
4,421,378 A 12/1983 Sanford et al.
4,684,187 A * 8/1987 Rudy, Jr. ..... H01R 13/424 439/595
4,698,030 A * 10/1987 Ryll ..... H01R 13/436 439/732
4,701,004 A * 10/1987 Yohn ..... H01R 13/426 439/744
4,810,214 A 3/1989 Yohn
5,055,055 A * 10/1991 Bakker ..... H01R 9/091 29/883
5,118,303 A * 6/1992 LeBaron ..... H01R 23/27 439/286
5,575,691 A * 11/1996 Matthews ..... H01R 43/22 439/744
5,595,505 A * 1/1997 Duke ..... H01R 4/34 439/630
5,653,612 A 8/1997 Peterson et al.
5,934,945 A * 8/1999 Petersen ..... H01R 13/426 439/744
6,149,472 A * 11/2000 Endo ..... H01R 13/434 439/745
6,713,711 B2 * 3/2004 Conway ..... B23K 9/323 219/121.48
6,773,304 B2 * 8/2004 Conway ..... H05H 1/34 439/595
7,156,681 B2 * 1/2007 Kaneda ..... H04R 1/1033 439/316
7,255,611 B2 * 8/2007 Kubo ..... H01R 13/03 439/748
D594,317 S * 6/2009 Anthony ..... D8/382
7,736,199 B2 6/2010 Cossette
7,942,707 B2 5/2011 Orris et al.
8,152,572 B1 4/2012 Liu
8,303,352 B2 11/2012 Hangartner et al.
8,708,747 B2 * 4/2014 Leroyer ..... H01R 13/2421 439/625
2014/0120760 A1 5/2014 Zieman et al.

* cited by examiner

HOUSING FOR ELECTRICAL CONTACT

FIELD OF THE INVENTION

The present invention relates to a housing for one or more electrical contacts, such as a pin or socket. More specifically, the present invention relates to a unitary one-piece housing configured to support a retention member for retaining the individual electrical contacts in the housing.

BACKGROUND OF THE INVENTION

Housings for electrical crimp contacts are typically multiple pieces that require the expense and difficulty of assembling and locking them together. In order to trap retention clips and crimped contacts in a housing, supporting surfaces are required to hold the components from pushing through as well as pulling out of the plastic housing. Therefore, a need exists for a unitary one-piece housing that simplifies assembly and installation of electrical contacts.

SUMMARY OF THE INVENTION

Accordingly, the present invention provides a housing for an electrical contact that includes a unitary one-piece body that has an internal bore that extends between a front end and an opposite rear end of the unitary one-piece body and is adapted to receive the electrical contact. A front holding member extends into the internal bore from an inner surface of the internal bore, and the front holding member is located at the front end of the one-piece body. A rear holding member extends into the internal bore, and is disposed on the inner surface of the internal bore at the rear end of the one-piece body. A contact retaining member receiving area is defined in the internal bore between the front holding member and the rear holding member for capturing a contact retaining member therebetween.

The present invention may further provide a housing assembly for an electrical contact that includes a unitary one-piece body that has an internal bore that extends between a front end and an opposite rear end of the unitary one-piece body and the internal bore is adapted to receive the electrical contact. A plurality of ledge portions extend into the internal bore from an inner surface of the internal bore. The ledge portions are located at the front end of the unitary one-piece body. A plurality of ridge portions extend into the internal bore and disposed on the inner surface of the internal bore. A contact retention member receiving area is defined in the internal bore between the plurality of ledge portions and the plurality of ridge portions. A contact retention member is received in the contact retention member receiving area. The contact retention member is flexible and includes at least one finger for catching the electrical contact.

The present invention may also provide a method of assembling a housing assembly for an electrical contact that includes the steps of providing a housing including a unitary one-piece body that has an internal bore that extends between a front end and an opposite rear end of the unitary one-piece body, the internal bore being adapted to receive the electrical contact, a plurality of ledge portions extending into the internal bore from an inner surface of the internal bore, the ledge portions being located at the front end of the one-piece body, a plurality of ridge portions extending into the internal bore, the plurality of ridge portions being disposed on the inner surface of the internal bore, and a contact retention member receiving area defined in the internal bore between the plurality of ledge portions and the plurality of ridge portions; providing a contact retention member that is flexible and has at least one finger for catching the electrical contact; compressing the contact retention member; inserting the compressed contact retention member into the internal bore of the housing at the rear end; and releasing the contact retention member such that the contact retention member expands into the contact retention member receiving area.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 3A:
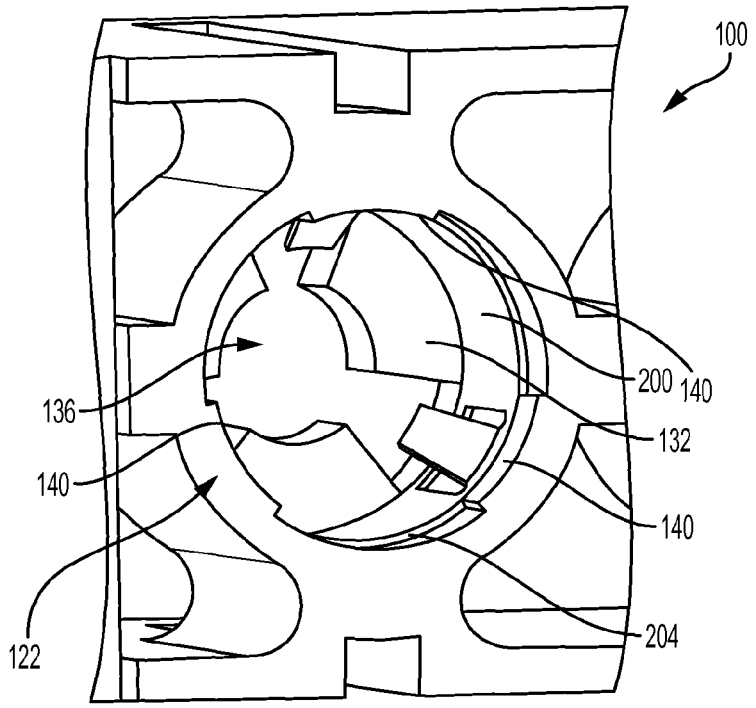
FIGS. 3A and 3B are rear and front perspective partial views, respectively, of the housing illustrated in FIG. 1.
Figure 3B:
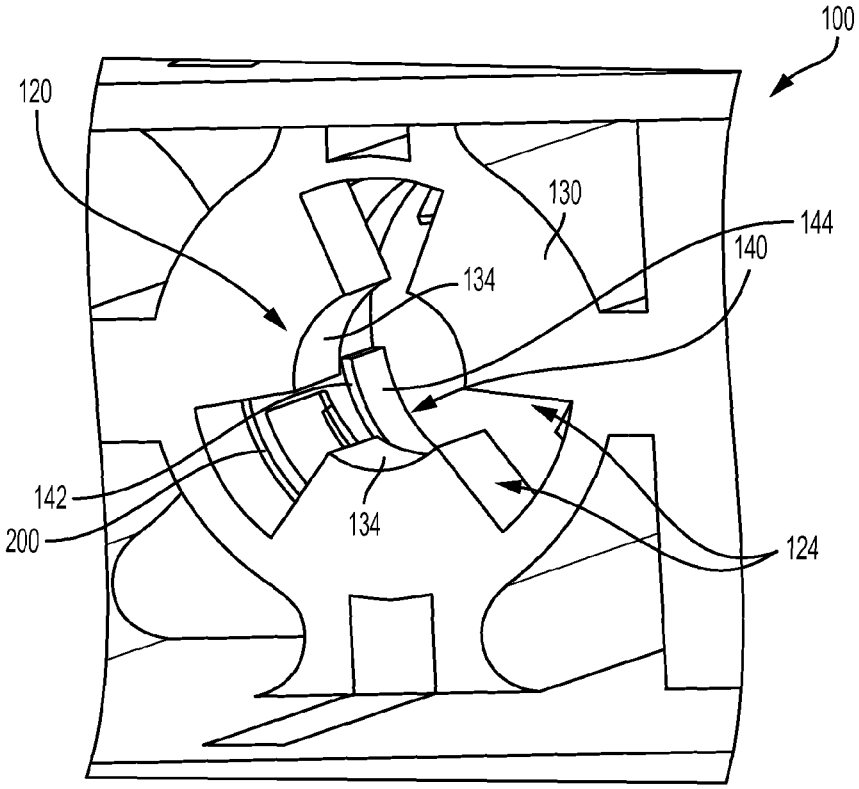
Figure 4:
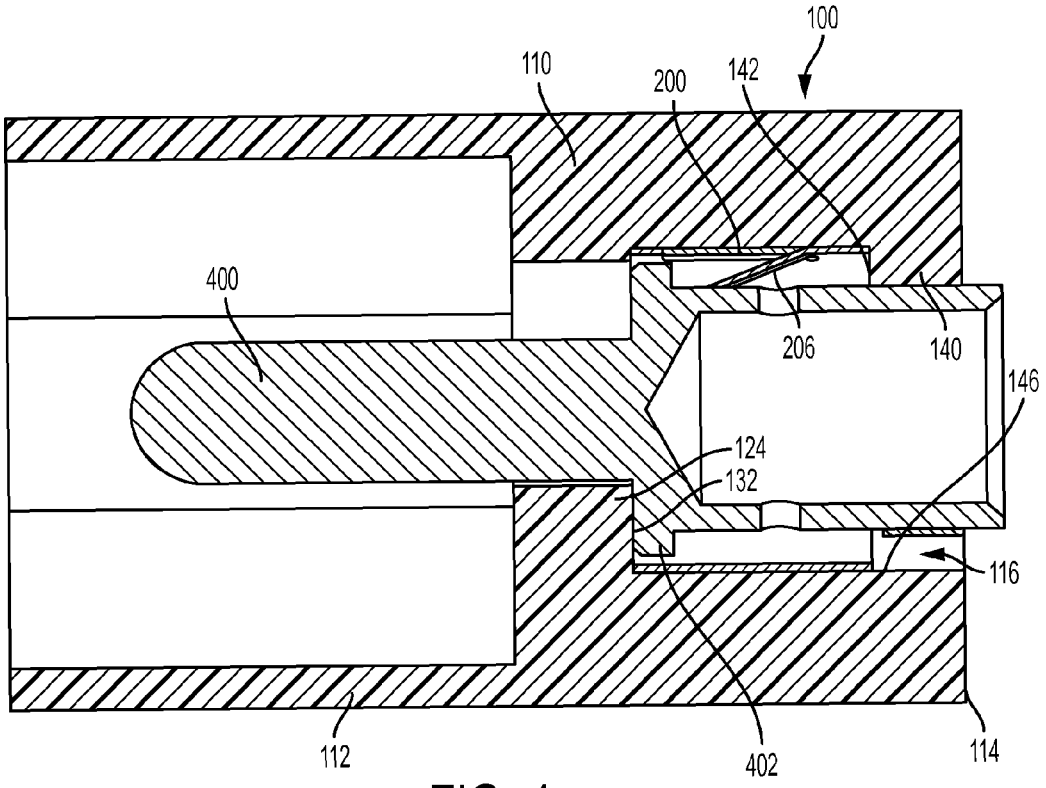
FIG. 4 is a side cross-sectional view of the housing illustrated FIG. 1, showing an exemplary electrical contact received in the housing.

Referring to FIGS. 1, 2, 3A, 3B, and 4, the present invention generally relates to a unitary one-piece housing 100 for one or more electrical contacts, such as a socket or pin 400 (FIG. 4). The housing 100 is preferably part of an electrical connector used for power supply and distribution. In general, the housing 100 includes a unitary one-piece body 110 that is preferably formed of plastic. The body 110 generally includes a front end 112, a rear end 114 opposite the front end 112, and one or more internal bores 116 therebetween for individually supporting the electrical contacts. The internal bore 116 holds a contact retention member 200, which retains the electrical contact. The contact retention member 200 is preferably a flexible clip, such as a metal C-clip, that may be compressed and expanded. However, the contact retention member may be any known flexible member for retaining an electrical contact.

Figure 1:
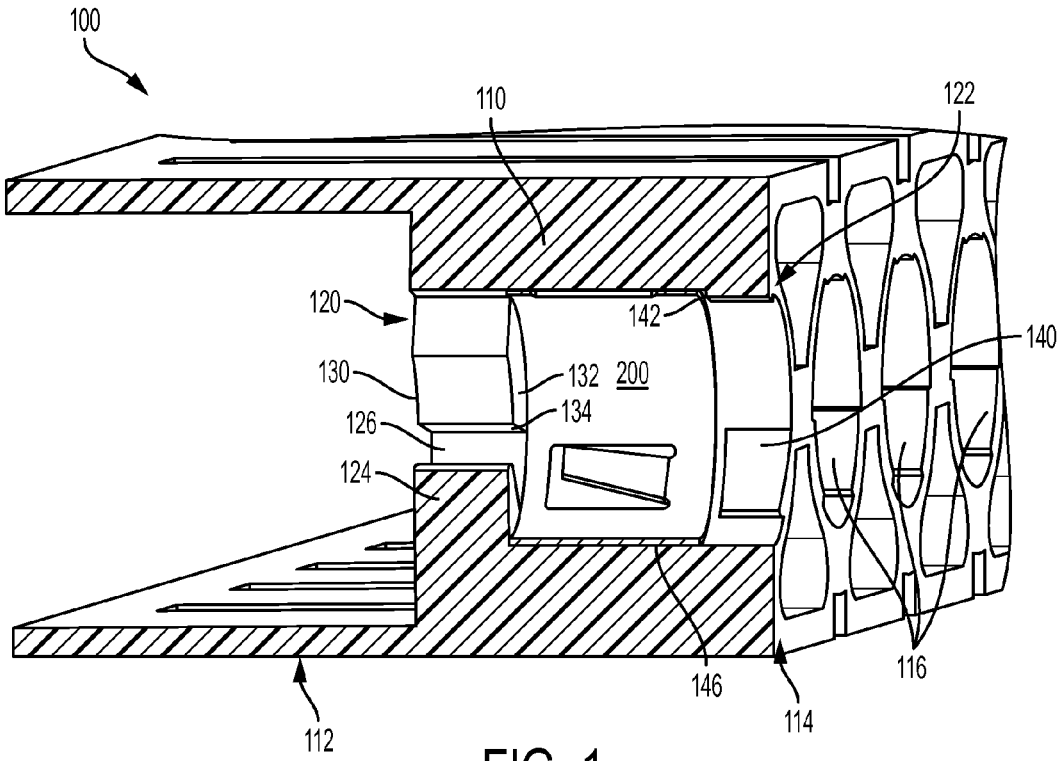
FIG. 1 is a perspective cross-sectional view of a housing according to an exemplary embodiment of the present invention.
Figure 2:
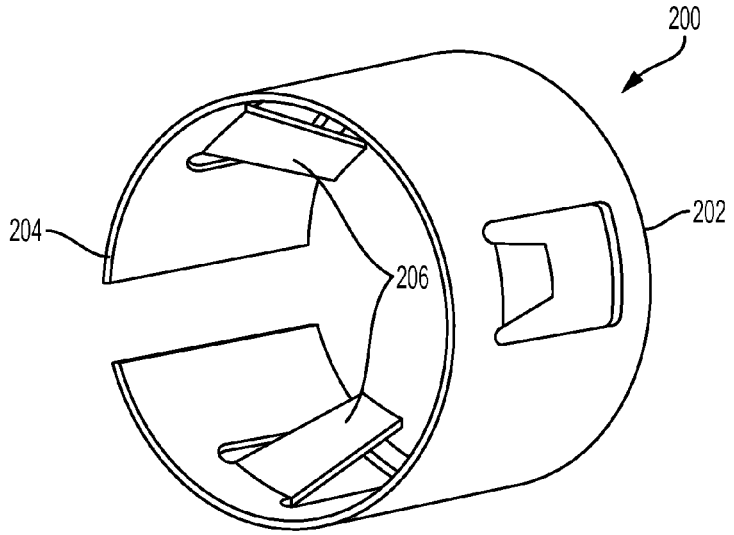
FIG. 2 is a perspective view of a contact retention member shown in the housing illustrated in FIG. 1.

The unitary one-piece body 110 includes front and rear holding members 120 and 122 for capturing the contact retention member 200. The front holding member 120 may include one or more ledge portions 124 extending into the internal bore 116 at the front end thereof, as seen in FIGS. 1 and 3B. In a preferred embodiment, there are three ledge portions 124 annularly spaced from one another along an inner surface 126 of the internal bore 116. Each of the ledge portions 124 may have a general trapezoidal shape and may include opposite front and rear facing surfaces 130 and 132 and an end face surface 134 therebetween. Each end face surface 134 may be substantially curved. The end face surfaces 134 of the ledge portions 124 preferably define an opening 136 that receives at least a portion of the electrical contact 400, as seen in FIG. 4.

The rear holding member 122 of the unitary one-piece body 110 may include one or more ridge portions 140 disposed on the inner surface 126 of the internal bore 116 at a rear end thereof, as seen in FIGS. 1 and 3A. Each ridge portion 140 includes an abutment shoulder 142 facing the ledge portions 124. An inner surface 144 of each ridge portion 140 extends from the abutment shoulder 142 and has a curvature that is consistent with and substantially matches the curvature of the internal bore's inner surface 126. In a preferred embodiment, there are three ridge portions 140 annularly spaced about the inner surface 126 of the internal bore 116.

Between the ledge portions 124 and the ridge portions 140 is defined a receiving area 146 in the internal bore 116 for retaining the contact retention member 200. More specifically, the receiving area 146 is defined between the rear facing surfaces 132 of the ledge portions 124 and the abutment shoulders 142 of the ridge portions 140. The contact retention member 200 is preferably captured in the bore's receiving area 146 such that one end 202 thereof is adjacent to or touching the rear facing surfaces 132 and an opposite end 204 thereof is adjacent to or touching the abutment shoulders 142.

The contact retention member 200 is preferably flexible such that it can be compressed or squeezed to be inserted into the housing 100. More specifically, the contact retention member 200 is compressed and then inserted into the internal bore 116 at the rear end 114 of the housing 100. The contact retention member 200 need only be compressed enough to clear the ridge portions 140. Once inserted into the internal bore 116 past the ridge portions 140, the contact retention member 200 is released, thereby allowing the contact retention member 200 to expand into the receiving area 146 between the ledge and ridge portions 124 and 140 such that the contact retention member 200 is in contact with and against the inner surface 126 of the internal bore 116.

The electrical contact 400 may then be inserted into the internal bore 116. The electrical contact 400 preferably includes a front shoulder 402 that abuts against one or more of the rear facing surfaces 132 of the ledge portions 124. The contact retention member 200 preferably includes one more flexible fingers 206 that extend inwardly to catch and retain the electrical contact 400 in the bore 116. These steps may be repeated for each electrical contact 400 to be inserted into a respective internal bore 116 of the housing 100.

While particular embodiments have been chosen to illustrate the invention, it will be understood by those skilled in the art that various changes and modifications can be made therein without departing from the scope of the invention as defined in the appended claims.

What is claimed is:

1. A housing for an electrical contact, comprising:

a unitary one-piece body, said unitary one-piece body having, an internal bore that extends between a front end and an opposite rear end of said unitary one-piece body, said internal bore being adapted to receive the electrical contact, a front holding member extending into said internal bore from an inner surface of said internal bore, said front holding member being located at said front end of said one-piece body, said front holding member includes a plurality of ledge portions extending into said internal bore, each of said ledge portions has opposite front and rear facing surfaces and an end face surface between, and said plurality of ledge portions are annularly spaced from one another, a rear holding member extending into said internal bore, said rear holding member being disposed on said inner surface of said internal bore at said rear end of said one-piece body, and a contact retaining member receiving area defined in said internal bore between said front holding member and said rear holding member for capturing a contact retaining member therebetween.

2. A housing according to claim 1, wherein said front holding member includes at least one ledge portion; and said rear holding member includes at least one ridge portion.

3. A housing according to claim 2, wherein said at least one ledge portion has opposite front and rear facing surfaces and an end face surface between said front and rear facing surfaces, said end face surface is substantially curved.

4. A housing according to claim 3, wherein said at least one ledge portion has a generally trapezoidal shape.

5. A housing according to claim 2, wherein said at least one ridge portion forming an abutment shoulder facing said retention member receiving area.

6. A housing according to claim 5, wherein said at least one ridge portion defines an inner surface extending from said abutment shoulder, said inner surface of said at least one ridge portion having a curvature that substantially matches the curvature of said inner surface of said internal bore.

7. A housing according to claim 1, wherein said end face surfaces defining an opening for receiving at least a portion of the electrical contact.

8. A housing according to claim 1, wherein said rear holding member includes a plurality of ridge portions disposed on said inner surface of said internal bore, said plurality of ridge portions are annularly spaced from one another on said inner surface.

9. A housing according to claim 8, wherein each of said ridge portions forming an abutment shoulder facing said contact retention member receiving area.

10. A housing assembly for an electrical contact, comprising:

a unitary one-piece body, said unitary one-piece body having, an internal bore that extends between a front end and an opposite rear end of said unitary one-piece body, said internal bore being adapted to receive the electrical contact, a plurality of ledge portions extending into said internal bore from an inner surface of said internal bore, said ledge portions being located at said front end of said unitary one-piece body, a plurality of ridge portions extending into said internal bore, said plurality of ridge portions being disposed on said inner surface of said internal bore, and a contact retention member receiving area defined in said internal bore between said plurality of ledge portions and said plurality of ridge portions; and a contact retention member received in said contact retention member receiving area, said contact retention member being flexible and including at least one finger for catching the electrical contact.

11. A housing assembly for an electrical contact according to claim 10, wherein each of said ledge portions has opposite front and rear facing surfaces and an end face surface between, said end face surfaces defining an opening for receiving at least a portion of a contact, and said plurality of ledge portions are annularly spaced from one another.

12. A housing assembly for an electrical contact according to claim 11, wherein said plurality of ridge portions are annularly spaced from one another on said inner surface, and each of said ridge portions forming an abutment shoulder facing said contact retention member receiving area, a rear end of said contact retention member is adjacent said abutment shoulders.

13. A housing assembly for an electrical contact according to claim 12, wherein said contact retention member is a metal C-clip.

14. A housing assembly for an electrical contact according to claim 13, wherein said unitary one-piece body is formed of plastic.

15. A method of assembling a housing assembly for an electrical contact, comprising the steps of:

providing a housing including a unitary one-piece body, the unitary one-piece body having, an internal bore that extends between a front end and an opposite rear end of the unitary one-piece body, the internal bore being adapted to receive the electrical contact, a plurality of ledge portions extending into the internal bore from an inner surface of the internal bore, the ledge portions being located at the front end of the one-piece body, a plurality of ridge portions extending into the internal bore, the plurality of ridge portions being disposed on the inner surface of the internal bore, and a contact retention member receiving area defined in the internal bore between the plurality of ledge portions and the plurality of ridge portions;

providing a contact retention member, the contact retention member being flexible and having at least one finger for catching the electrical contact; and compressing the contact retention member;

inserting the compressed contact retention member into the internal bore of the housing at the rear end; and releasing the contact retention member such that the contact retention member expands into the contact retention member receiving area.

16. A method of assembling according to claim 15, further comprising the step of inserting an electrical contact into the internal bore; and the contact retention member including at least one finger for retaining the electrical contact in the internal bore.

17. A method of assembly according to claim 16, wherein each of the ledge portions has opposite front and rear facing surfaces and an end face surface between, the end face surfaces defining an opening for receiving at least a portion of the electrical contact.

18. A method of assembly according to claim 16, wherein each of said ridge portions forming an abutment shoulder facing the contact retention member receiving area.

19. A method of assembly according to claim 17, wherein the contact retention member is a flexible metal C-clip; and the unitary one-piece body is formed of plastic.

20. A housing for an electrical contact, comprising:

a unitary one-piece body, said unitary one-piece body having, an internal bore that extends between a front end and an opposite rear end of said unitary one-piece body, said internal bore being adapted to receive the electrical contact, a front holding member extending into said internal bore from an inner surface of said internal bore, said front holding member being located at said front end of said one-piece body, a rear holding member extending into said internal bore, said rear holding member being disposed on said inner surface of said internal bore at said rear end of said one-piece body, and said rear holding member includes a plurality of ridge portions disposed on said inner surface of said internal bore, said plurality of ridge portions are annularly spaced from one another on said inner surface, and a contact retaining member receiving area defined in said internal bore between said front holding member and said rear holding member for capturing a contact retaining member therebetween.

* * * * *